United States Patent [19]

Butler

[11] 4,370,786

[45] Feb. 1, 1983

[54] WIRE LEAD FORMING MACHINE

[75] Inventor: John D. Butler, New Berlin, Wis.

[73] Assignee: Artos Engineering Company, New Berlin, Wis.

[21] Appl. No.: 235,443

[22] Filed: Feb. 20, 1981

[51] Int. Cl.[3] ..... B21F 23/00; B21F 1/02

[52] U.S. Cl. ..... 29/33 M; 29/33 F; 29/564.1; 29/564.2; 29/564.6

[58] Field of Search ..... 29/33 F, 33 M, 564.1, 29/564.2, 564.4, 546.6, 56.6; 140/147; 81/9.5 R; 29/747, 748, 858, 859

[56] References Cited

U.S. PATENT DOCUMENTS

| | | | |
|---|---|---|---|
| 3,707,756 | 1/1973 | Wolyn | 29/748 |
| 4,183,383 | 1/1980 | Gudmestad et al. | 140/105 |
| 4,196,510 | 4/1980 | Gudmestad et al. | 29/33 M |

*Primary Examiner*—Francis S. Husar
*Assistant Examiner*—Jonathan L. Scherer
*Attorney, Agent, or Firm*—James E. Nilles

[57] ABSTRACT

In a wire lead forming machine whereby a European-type plug is attached to plug-end portions of two wires of a cable length, a wire bending device at each of a wire stripping and a plug attachment station has a pair of carriages mounted on parallelogram linkages for horizontal translatory movement. A clamping element on each carriage swings down to clamp a wire end portion against a flat top surface portion on the carriage, whereupon the carriages diverge, bending the wires to hold their tip portions parallel and spaced apart. A restraightening device at a station between the stripping and the plug attachment stations has upper and lower jaws between which the wires are received. The upper jaw swings down to confine the wire end portions in coplanar relationship, whereupon other jaws, moving horizontally between the upper and lower jaws, push the wires together.

6 Claims, 21 Drawing Figures

42
43
8
41
27

D
38b
49
14
49
32
32
138
38
40
40
38a
33
33
57
57
35
29'
29
58
58
30
8
36

47
27
41
38b 49
45
46
14
38
9
6
15
52
53
44
46a
10b
62
29
30
37
35

WIRE LEAD FORMING MACHINE

FIELD OF THE INVENTION

This invention relates to apparatus for making two-conductor wire leads, each having a two-prong plug at one of its ends and having the other ends of its wires prepared for connection to the terminals of an appliance or the like, as by being bared and tinned or crimped to terminal connectors. The invention relates more particularly to an improved wire lead machine capable of use both with relatively stiff wires that tend to maintain a configuration to which they have bent and with relatively limp wires that tend to return to straightness after being bent.

BACKGROUND OF THE PRIOR ART

U.S. Pat. No. 4,183,383 discloses a wire lead forming machine of the general type to which the present invention relates, whereby each of a succession of cable lengths has a European-type two-pronged plug applied to one end of it while electrically connectable terminal leads are formed at its other end. That machine has a main conveyor comprising a pair of endless chains, each carrying wire clamps spaced at intervals along it. Horizontally extending and parallel top stretches of the respective chains, at opposite sides of the machine, move stepwise in unison to carry their wire clamps to each of a succession of stations along the length of the machine.

Successive lengths of two-conductor cable are delivered to the machine at an infeed end of it. They are oriented to extend transversely to the chains, and each cable length is gripped near its opposite ends by wire clamps on the respective chains. After each cable length is gripped by the wire clamps, it is brought to a station at which the outer insulating jacket is stripped off of each of its end portions, to expose end portions of the two insulated wires within that jacket. At a subsequent wire inserting station these end portions, at the plug end of the cable length, are engaged by one of a series of movable wire-controlling fixtures that are secured to an endless auxiliary conveyor. The auxiliary conveyor has a top stretch paralleling the top stretches of the main conveyor chains but extending along only a part of the length of the machine, and it moves in unison with the main conveyor.

At an actuating station after the wire inserting station, an actuator drivingly engages swingable parts of the movable wire controlling fixture, and the displacement of those parts bends the plug-end portions of the two wires to such configurations that, together, they define a U, with their tip portions parallel and spaced apart by a substantial distance in the direction of conveyor travel. The swingable parts of the movable fixture maintain their displaced setting to confine these end portions of the wires in the bent configuration as the fixture and cable length are carried through further stations. One of those further stations is a wire stripping station where insulation is removed from the tip portion of each wire by means of a pair of rotary devices, rotating side by side, each of which cuts through the insulation on one of the wires, grips the insulation, and pulls if off of the wire. Since the strippers rotate on fixed axes, the fixture that is carried by the auxiliary conveyor serves to hold the plug-end portions of the two wires in such positions and orientations that they are accurately coaxial with the rotary strippers and can be properly engaged by them for simultaneous insulation stripping.

From the wire stripping station the cable length is carried to a plug-attachment station where the stripped wire ends are inserted into tubular rear legs of plug prongs and those legs are crimped to secure them to the wires. At the plug-attachment station the movable fixture continues to maintain the plug-end portions of the wires in their bent configuration, ensuring that they will be located and oriented for accurately coaxial insertion into the tubular plug prong legs. Thereafter, as the conveyors move to a fixture resetting station, the plug end portion of the cable length is engaged by a ramp that lifts it out of the movable fixture, and at said resetting station the swingable parts of the fixture are reset back to their original condition. The subsequent orbital movement of the fixture with the auxiliary conveyor carries the movable fixture back towards the infeed end of the machine. Meanwhile, the cable length, with a plug now attached to it, moves on towards the discharge end of the machine, where it is released from the cable clamps on the main conveyor.

The wire-controlling movable fixtures on the auxiliary conveyor are relatively complicated and expensive devices. In their stepwise movement with the auxiliary conveyor they must be brought accurately into position at each of the fixture actuating, wire stripping, plug attaching and fixture resetting stations, and their swingable parts must be carefully made for precise cooperation with the mechanisms at those stations. The substantial cost of an individual fixture is multiplied by the relatively large number of such fixtures that must be attached to the auxiliary conveyor. Further cost is of course involved in the provision of the auxiliary conveyor itself and in the means for driving it in unison with the main conveyor and for indexing it for accurate positioning of every movable fixture at each station.

The machine of U.S. Pat. No. 4,183,383 has enjoyed substantial commercial success, so that there has been a great deal of practical experience with it. Thus the cost and complexity of the auxiliary conveyor and its multiplicity of wire controlling fixtures have been apparent for some time, but heretofore it has been far from obvious how to achieve a simplification and reduction of cost in the mechanism at the plug attaching side of the machine without loss of the reliability and versatility that are mandatory in such machines.

There would perhaps be relative little difficulty in simplifying a lead forming machine if it were intended only for use with relatively stiff wire that would maintain any configuration to which it might be bent. However, the type of cable to which a two-prong plug or the like is to be attached must ordinarily be so limp and supple that after being bent it has a tendency to return to straightness as soon as it is released. This suppleness or lack of memory in the wires of the cable poses one of the problems addressed by the present invention.

The wires must have their plug end portions bent apart for insulation stripping because they must be separated from one another for engagement by the rotary strippers. Conceivably the wires could be stripped one at a time, as is done at the opposite (terminal lead) side of the machine, and in that case the two wires would not have to be positioned and oriented with the accuracy that is needed for simultaneous insulation stripping. But when a cable length reaches the plug-attaching station, the plug-end portions of its wires must have a fairly accurate positioning and orientation, to ensure their simultaneous entry into the relatively narrow tubular legs of a plug. If the wires are not to be confined by means of a movable fixture that travels with them from station to station, then they must be brought to and maintained in the required positions and orientations by a reliable device that is stationarily located at the plug attachment station. And if no operation is performed upon the plug-end portions of the wires between the insulation stripping station and the plug attaching station, they will arrive at the latter in unpredictable positions and orientations, owing to their suppleness and tendency to straighten themselves. A reasonably simple and compact fixture at the plug attaching station could not assuredly bring whose wire end portions into accurate relationship to plug prongs if it had to be capable of receiving and engaging those wire portions in any of a wide range of possible positions and orientations.

Accurately positioning and orienting the plug end portions of the wires by means of a fixture or the like that is stationarily located at the plug attaching station poses another problem that has heretofore been rather baffling. With the movable wire controlling fixtures of U.S. Pat. No. 4,183,383, the bending of the plug-end portions of the wires could take place at a special setting station where an actuator could engage the movable fixture to shift its swingable parts for bending of the wire; and that actuator could be designed with little concern about its interference with the mechanisms for insulation stripping and for plug attachment inasmuch as such mechanisms were located at other stations, well spaced from the actuator. On the other hand, if the plug-end portions of the wires are to be bent and confined in a fixture or the like that is stationarily located at the plug attachment station, then neither that fixture nor the mechanism for actuating its movable parts should get between the tips of the wires and a plug to be attached to them, nor otherwise interfere with assembly of the wires and the plug. In effect, the whole of such a fixture and its actuating mechanism should be located at one side of a vertical plane that extends in the direction of conveyor movement and intersects the plug-end portions of the wires near their tips.

SUMMARY OF THE INVENTION

The general object of the present invention is to provide a simplified and less expensive wire lead forming machine of the general type shown in U.S. Pat. No. 4,183,383, but not having the auxiliary conveyor and its multiple fixtures of the machine of that patent, although nevertheless capable of operating reliably on both supple and stiff conductor cables.

Another and more specific object of the invention is to provide a wire lead forming machine having one or more stations at which an operation is performed on an end portion of each of two wires of a cable, which operation requires that the wires be bent to and maintained in a divergent relationship with their tip portions parallel and at a predetermined distance from one another, said machine having at each such station a device for receiving the end portions of the wires when they are in substantially straight laterally adjacent relationship and for bending them to and maintaining them in the desired divergent relationship.

It is also a specific object of the invention to provide in a lead forming machine, a wire bending and holding device of the character just described, which device is of relatively simple construction, leaves the tip portions of the wires exposed and accessible to be operated upon by another mechanism, and is so arranged as not to interfere with the operation of such other mechanism.

A further specific object of the invention is to provide a wire bending and holding device of the type just described that firmly holds end portions of wires upon which an operation is to be performed, both during bending of the wires and during the subsequent performance of said operation by another mechanism, which device accommodates the foreshortening of the wires that occurs as they are bent into divergent relation to one another.

Another specific object of the invention is to provide a restraightening device for a wire lead forming machine that has at one of its stations a wire bending and holding device of the character just described and has at a preceding station a simple and effective restraightening device that can receive the end portions of the wires in more or less divergent and crooked condition and whereby they are brought back to substantially straight laterally adjacent relationship for presentation of the bending and holding device.

BRIEF DESCRIPTION OF THE DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
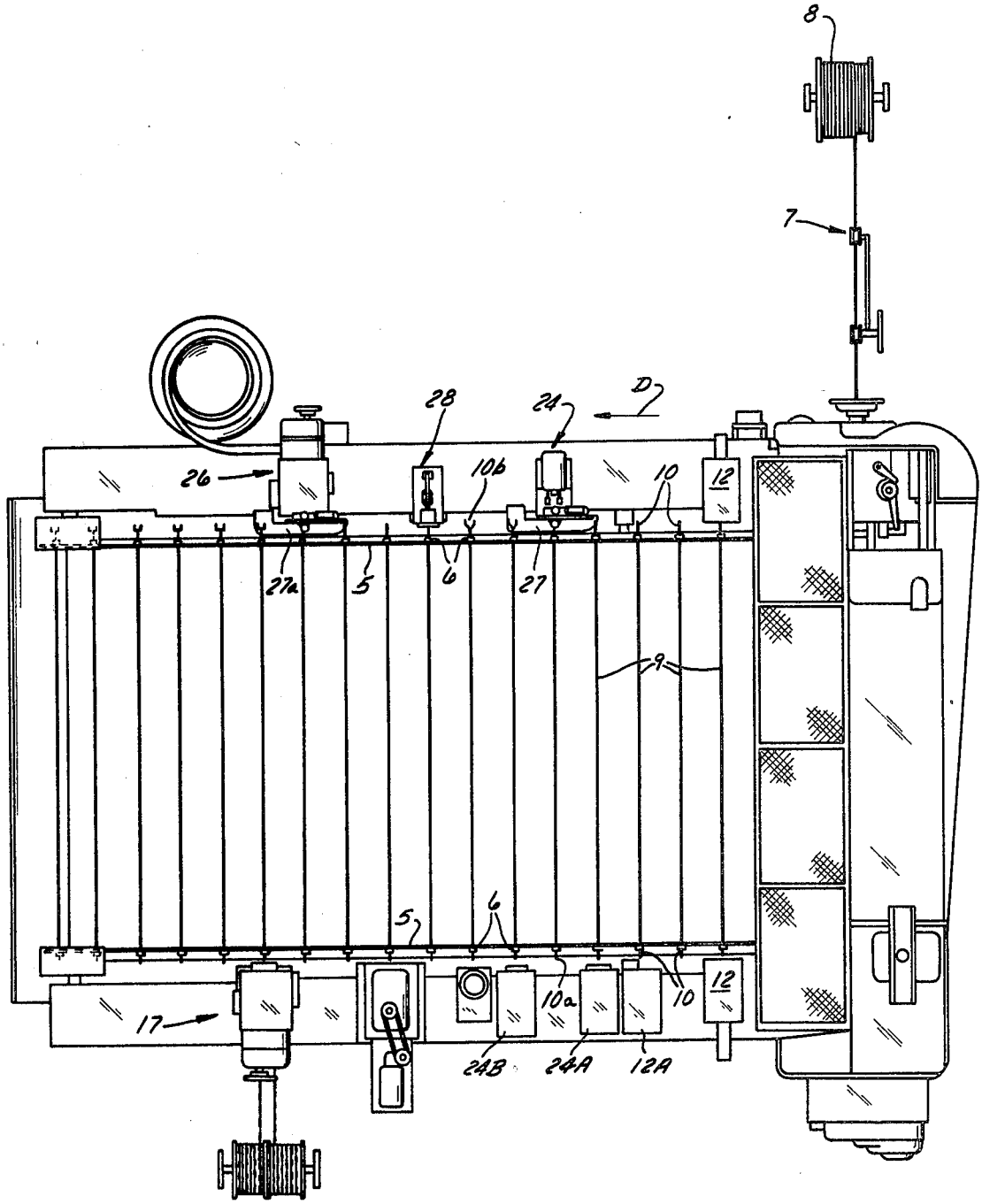
FIG. 1 is a plan view of a wire lead machine embodying the principles of this invention.
Figure 2:
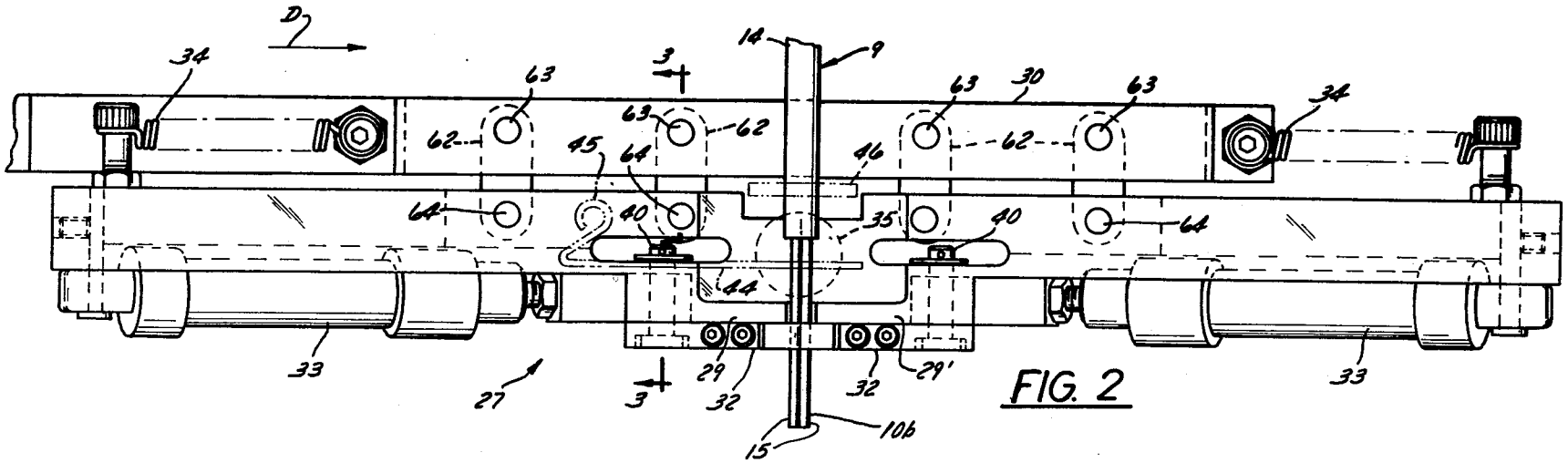
FIG. 2 is a plan view on a larger scale of that portion of one of the wire spreaders that comprises its carriages, their clamping elements and the pneumatic actuators for the same, and certain of the wire guiding elements, the carriages being shown in converged relationship.

As best seen in FIG. 1, a wire lead forming machine of this invention has a conveyor comprising a pair of endless chains with parallel top stretches 5 that extend along opposite sides of the machine and are disposed in a common horizontal plane. Wire clamps 6 are secured to each chain at regular intervals along it, and the two chains are driven stepwise in unison in one direction, to carry each wire clamp 6 to each in turn of a succession of stations along the length of the machine, as described hereinafter. The direction of movement of the upper chain stretches 5, which is indicated in each of the figures by an arrow D, is such as to carry the wire clamps 6 from an infeed end of the machine to a discharge end of it.

By means of known mechanism 7 at the infeed end of the machine, two-conductor cable is drawn off of a supply reel 8 and cut into predetermined lengths 9, and each such cable length is presented to a wire clamp 6 on each of the chains, to be gripped by those clamps for transport to the successive stations. While gripped and transported by the clamps 6, each cable length 9 extends transversely to the top chain stretches 5, with a lead-end portion 10*a* projecting beyond the clamp 6 at one side of the machine and a plug-end portion 10*b* projecting beyond the other clamp 6 at the other side of the machine.

At a first station, a jacket stripper 12 at each side of the machine strips off end portions of the outer insulating jacket 14 of the cable, exposing the opposite end portions of the two insulated wires 15 that comprise the cable.

At each cable length 9 is subsequently moved stepwise along the machine by the conveyor comprising the clamps 6, generally conventional apparatus 17 operates upon the wires 15 at one of their end portions to prepare them for connection to terminals of an appliance or the like. The tips of these end portions of the wires may be stripped of their insulation by means of apparatus 12A that can be generally similar to jacket stripper 12, and terminal connectors may then be crimped to the bared tips by means of generally conventional terminal attaching apparatus 17. Alternatively, the tip portion of each of the wires 15 may be stripped of insulation and twisted, as by means of conventional strippers-twisters 24A, 24B, and thereafter the bared and twisted wire tips may be tinned. The generally conventional operations for performing these operations is located at the side of the machine that is herein designated its rear side.

The portions of the machine that have been described to this point are generally known and conventional. Further information concerning these parts of the machine can be found in the above-mentioned U.S. Pat. No. 4,183,383 and prior patents therein cited.

Figure 18:
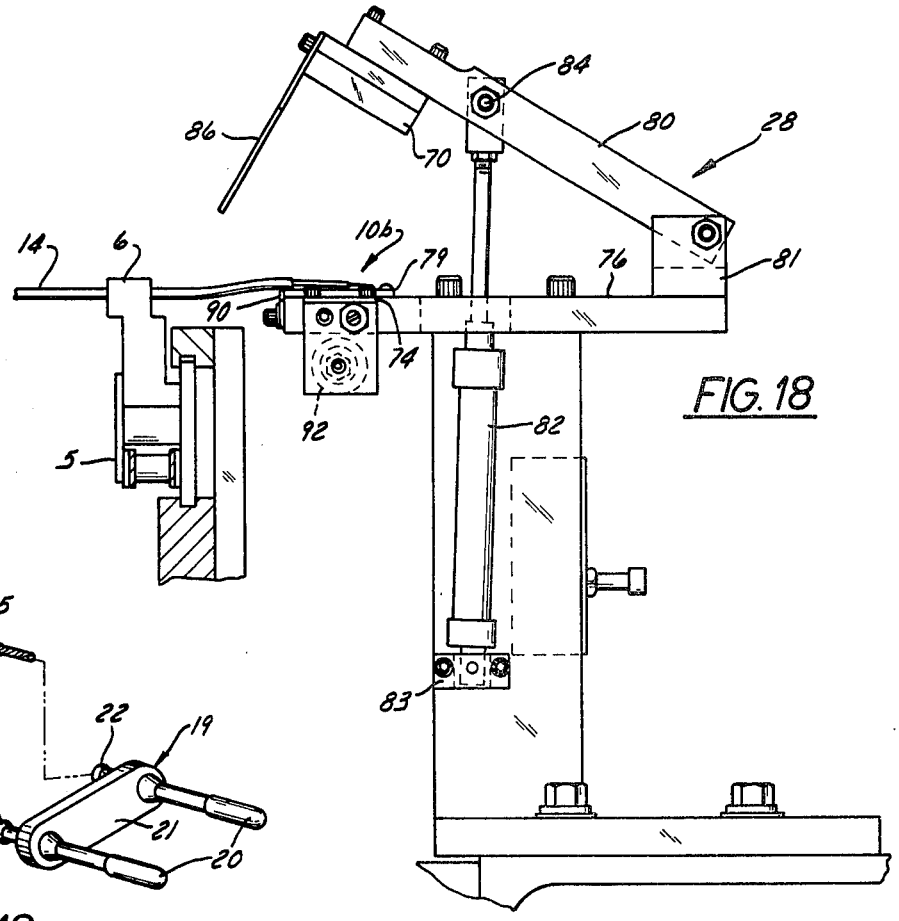
FIG. 18 is a view of the straightening device in side elevation, in its condition shown in FIGS. 14 and 15.
Figure 18A:
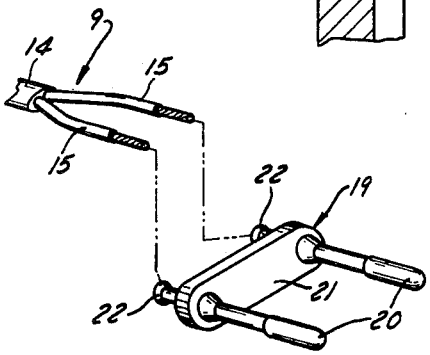
FIG. 18*a* is a perspective view of the plug-end portions of the wires in their divergently bent condition and in their relationship to a plug to be attached to them.
Figure 19:
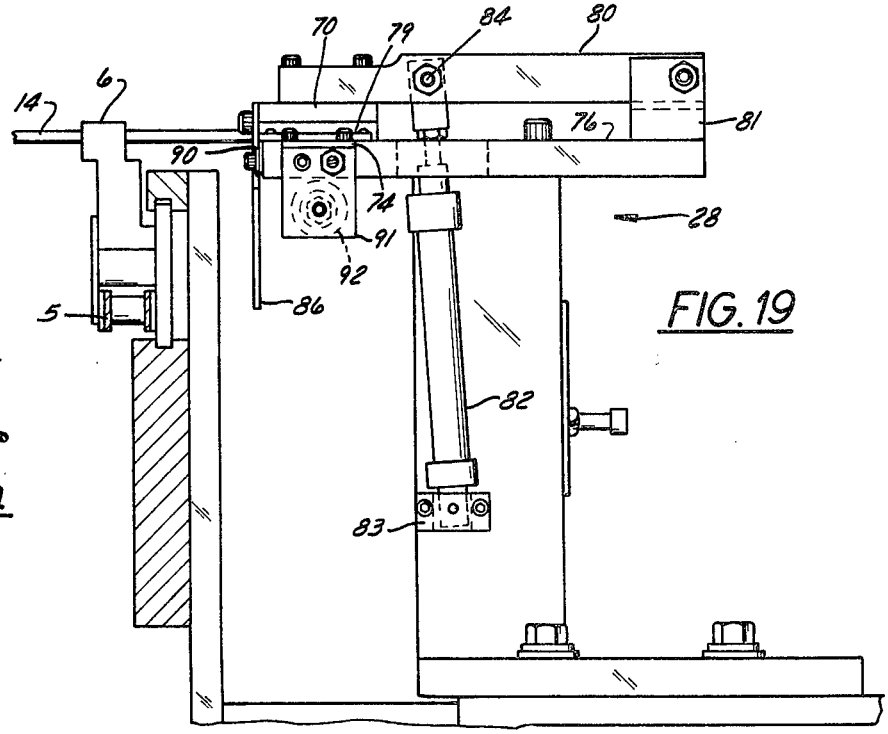
FIG. 19 is a view generally corresponding to FIG. 18 but with the straightening device in the condition in which it is shown in FIGS. 16 and 17.
Figure 19A:
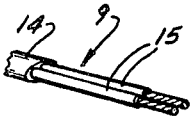
FIG. 19*a* is a perspective view showing the plug-end portions of the wires after they have been acted upon by the straightening device.

Apparatus at the front side of the machine, now to be described and embodying novel features of the present invention, strips insulation off of the front tip portion of each wire of the cable length and brings those bared wire-end portions into inserted and connected relationship to a male plug 19 (FIG. 18*a*). The particular plug 19 to be attached to each cable length 9 by means of the machine in its herein-described embodiment is of the European type, having a pair of elongated cylindrical prongs 20 held in spaced, parallel relation by an insulating connector 21. The prongs 20 have rounded or bullet-nose front ends, and each has its rear portion formed as a coaxial, rearwardly opening tubular leg 22 in which the bared tip portion of a wire 15 is received and which is crimped to the wire. To accommodate slight misalignments between the wire tips and the plug lugs 22 at insertion, each plug leg has a funnellike rearwardly flared rear end portion, as is generally conventional.

The apparatus at the front side of the machine includes more or less conventional rotary insulation strippers 23 (FIG. 11) at an insulation stripping station 24 (FIG. 1) to which each cable length 9 is brought after it leaves the jacket stripping station 12. The insulation strippers 23, which rotate on parallel axes (see FIG. 11), advance axially in unison to engage the two wires 15 and cut through their insulation, then withdraw axially while still rotating to pull the insulation off of the tip portions of both wires. For the strippers 23 to engage and strip both wires 15 simultaneously, the plug-end portions of those wires must be rather accurately coaxial to the respective strippers. However, as a cable length 9 comes into the insulation stripping station from the jacket stripping station 12, the plug-end portions of its wires 15 are more or less straight and laterally adjacent to one another. Therefore, there is a wire spreader or shaper device 27 at the insulation stripping station by which the straight plug-end portions of the wires 15 are bent to and confined in the mutually divergent relationship shown in FIG. 11, to establish their tip portions in coaxial relation to the respective rotary strippers 23.

As the cable length 9 moves away from the insulation stripping station 24, the plug-end portions of its wires tend to straighten themselves out of the configuration to which they were bent at that station. At a subsequent plug-attachment station 26 they must be returned to the relative positions and orientations that they had at the insulationstripping station, in order to enter the tubular legs 22 of plug prongs; and therefore the mechanism at the plug-attachment station comprises a wire spreader device 27*a* that can be identical with the wire spreader 27 at the insulation stripping station. The mechanism for bringing the prong legs 22 and the wires 15 into assembled relationship and for crimping the prong legs is known being described under the heading "the plug attachment mechanism" in U.S. Pat. No. 4,183,383.

Proper operation of each spreader device 27, 27*a* requires that the plug-end portions of the wires 15 be fairly straight and closely adjacent to one another when they are presented to the spreader, whereas those portions of the wires tend to have indeterminate positions and orientations after the cable length leaves the insulation stripping station 24. Therefore the machine of this invention includes a restraightening device 28, located between the insulation stripping station 24 and the plug attachment station 26 and spaced from both of those stations, whereby the plug-end portions of the wires 15 are brought back to substantial straightness and proximity before being presented to the spreader 27*a* at the plug attachment station.

WIRE SPREADERS

Figure 9:
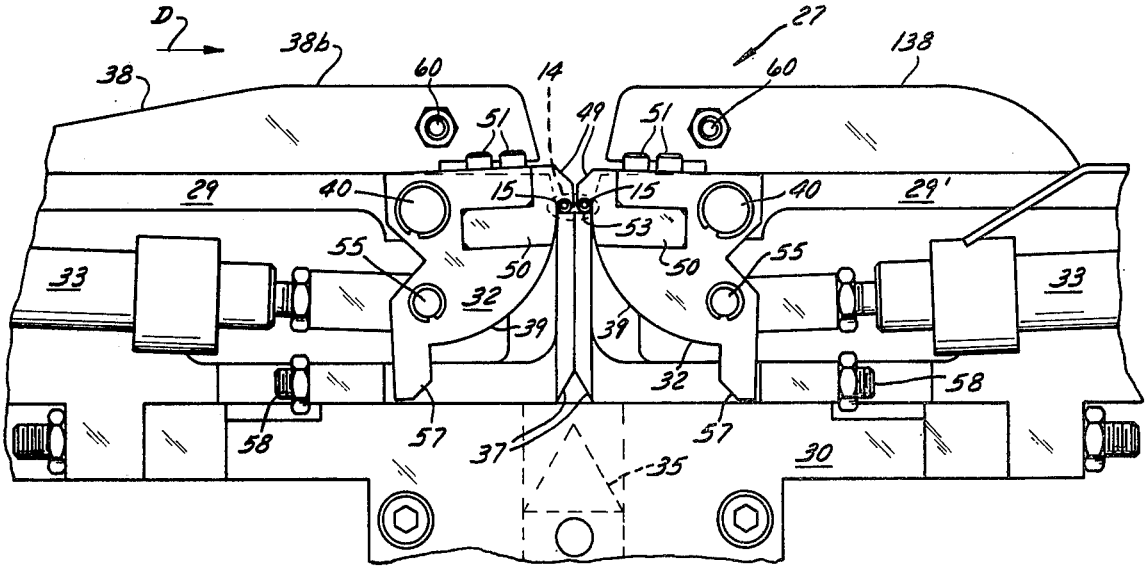
FIG. 9 is an enlarged detail view of the wire spreader with its clamping elements in closed, operative positions but its carriages still converged.
Figure 10:
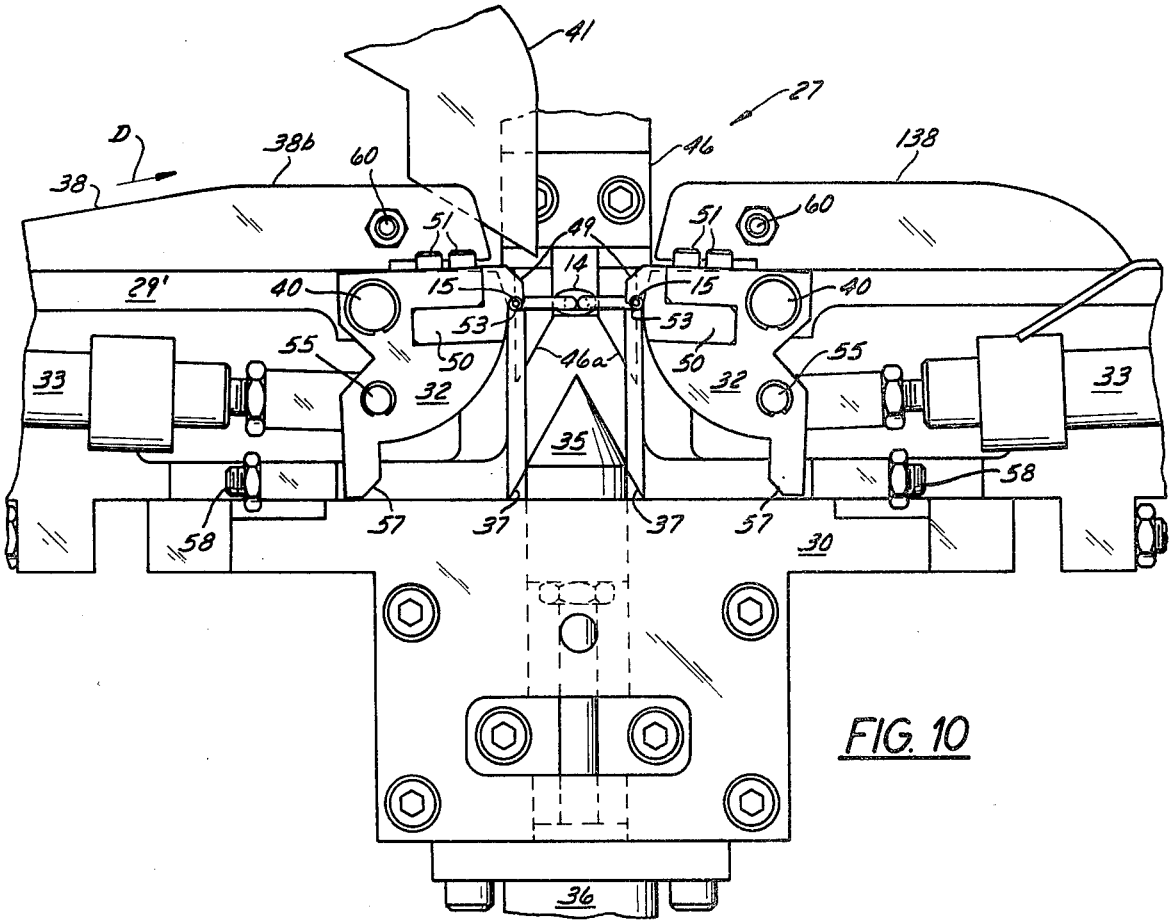
FIG. 10 is a view generally similar to FIG. 9 but showing the wire spreader in the condition in which its carriages are diverged to spread the plug-end portions of the wires.

FIGS. 2–12 particularly illustrate the wire spreaders 27 and 27*a*, each of which comprises a pair of carriages 29, 29′ that are mounted on the stationary machine structure 30 for horizontal movement relative to it and to one another, in opposite converging and diverging directions. The plug-end portions of the wires 15 are temporarily clamped to the respective carriages 29, 29′ by means of a swingable clamping element 32 on each carriage, so that divergent movement of the carriages spreads the plug-end portions of the wires. Also mounted on each carriage 29, 29′ for movement with it is a double-acting pneumatic cylinder jack 33 that actuates the clamping element 32 on the carriage, swinging it up to an open or inoperative position (FIGS. 5 and 7) and down to an operative position (FIGS. 9 and 10). Connected between each carriage 29, 29′ and the stationary structure 30 of the machine is a coiled tension spring 34 that biases the carriage for movement towards the other carriage. The springs 34 thus tend to maintain the carriages 29, 29′ in converged, wire-receiving positions shown in, e.g., FIGS. 2 and 9.

Figures 11, 12:
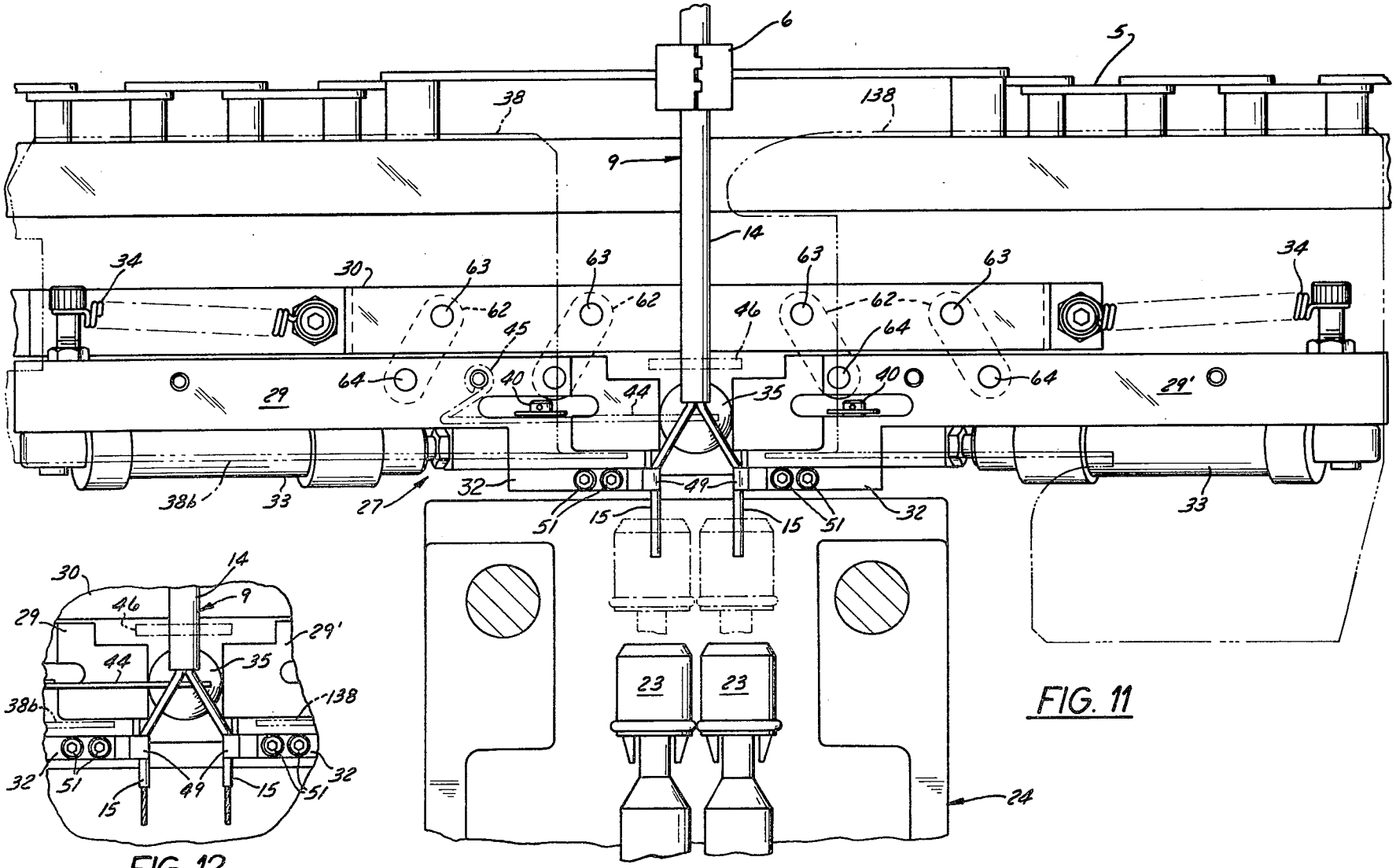
FIG. 11 is a plan view of the wire spreader, in the condition in which it is shown in FIG. 10 and in relation to rotary insulation strippers.
FIG. 12 is a detail view in elevation, corresponding to a portion of FIG. 11, showing the wires after insulation stripping, together with the portions of the wire spreader that are adjacent to them.

The carriages 29, 29′ are moved apart by a carriage actuator on the stationary structure of the machine, mounted beneath the carriages and on the vertical plane of symmetry between them, comprising a wedging element 35 movable up and down by a coaxial pneumatic cylinder 36. The wedging element 35 can comprise a pin with a conical upper end portion. When it is in a lowered position, downwardly spaced from the carriages 29, 29′, it permits them to maintain their converged positions. After plug-end portions of wires 15 are clamped to the respective carriages 29, 29′ by actuation of the clamping elements 32 to their operative positions, the wedging element 35 is raised by its pneumatic actuator 36, so that its conical top portion engages opposing bevel surfaces 37 on the carriages and wedgingly inserts itself between them to diverge them and thereby spread the wires, as shown in FIG. 11.

As a cable length is moved into a station comprising a wire spreader, its plug-end portion 10*b* tends to droop, owing to its suppleness, but a ramp 38, secured to the carriage 29 that it first passes, engages that end portion of the cable to help it across the clamping element 32 on said carriage 29. The ramp 38 can comprise an elongated piece of sheet metal having a 90° twist intermediate its ends to provide it with a broad entry surface 38*a* that is first encountered by the cable length and an upright portion 38*b* which is just behind the adjacent clamping element 32 and which has a top edge whereon the cable rides across that clamping element.

A generally similar ramp 138 can be secured to the other carriage 29′ to control the end portion 10*b* of the cable length as it leaves the station.

Each of the clamping elements 32 is pivoted, as by a trunnion 40, to swing across the front face of its carriage 29, 29′ about a rearwardly extending horizontal axis. The two clamping elements 32 have opposing arcuate surfaces 39 which are concentric to their respective pivot axes and which, when the clamping elements are raised, together define a downwardly convergent throat at which the ramp 38 terminates and wherein the plug-end portions of the wires 15 are received as they come off of that ramp.

Figure 6:
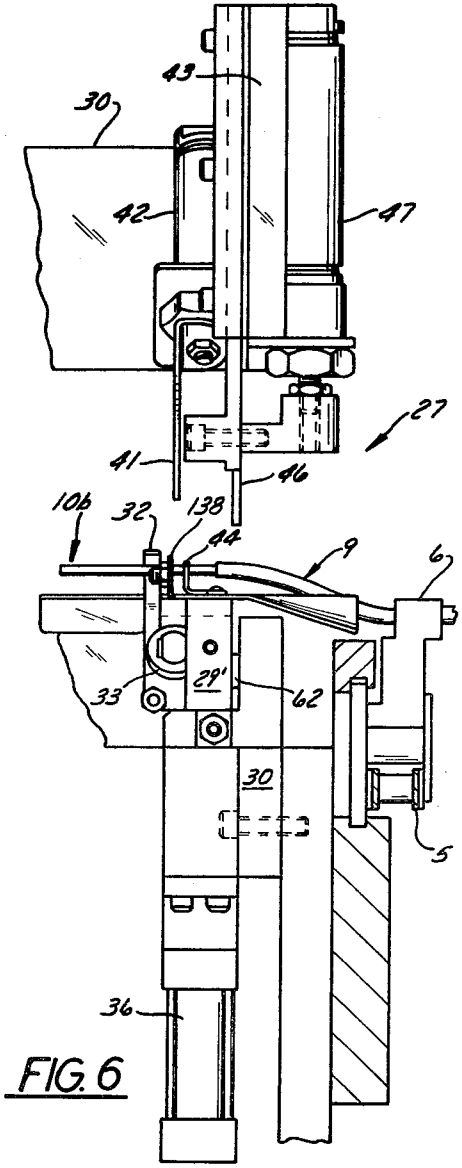
FIG. 6 is a view in side elevation of the wire spreader in its condition shown in FIG. 5
Figure 5:
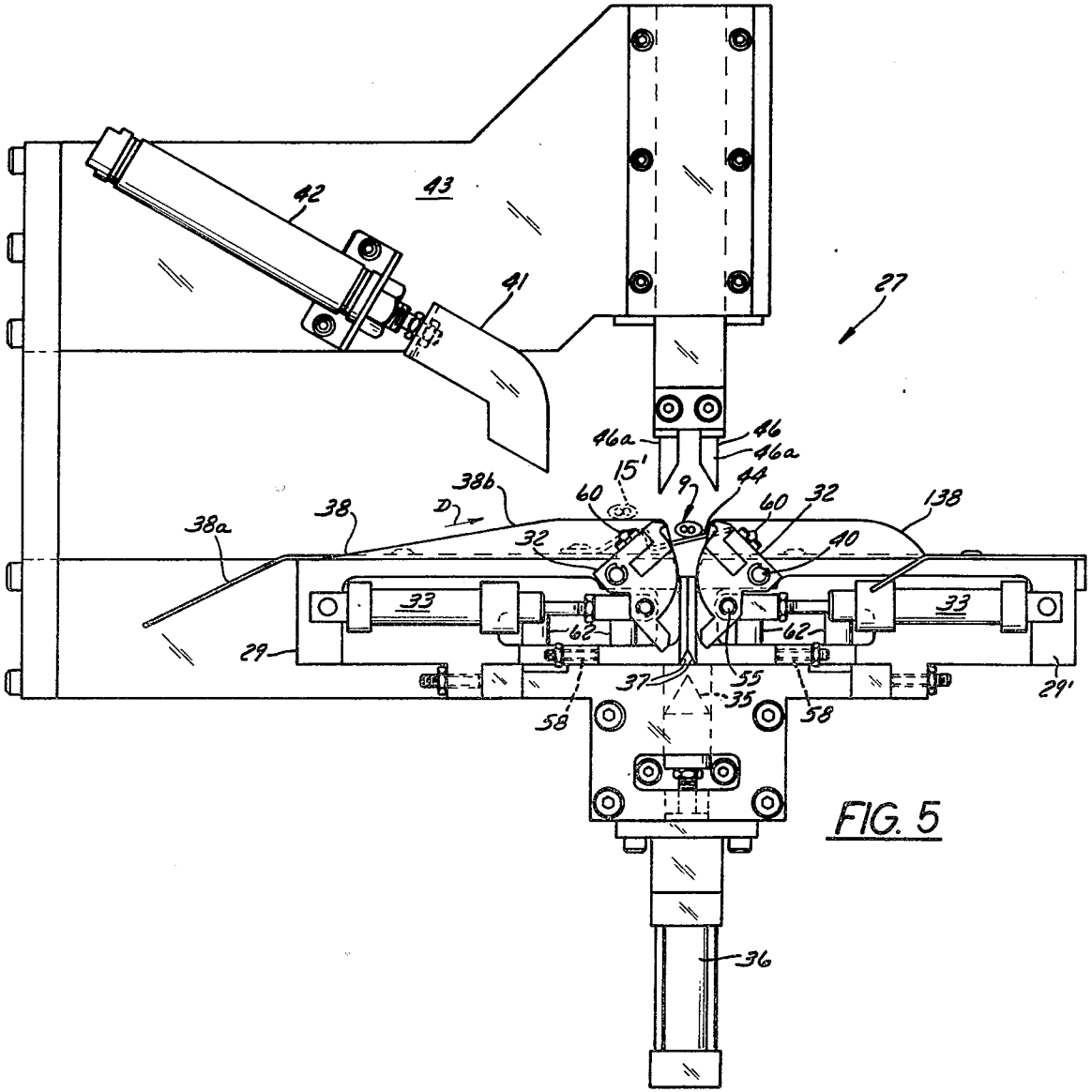
FIG. 5 is a view in front elevation of a wire spreader in its initial wire receiving condition.
Figure 7:
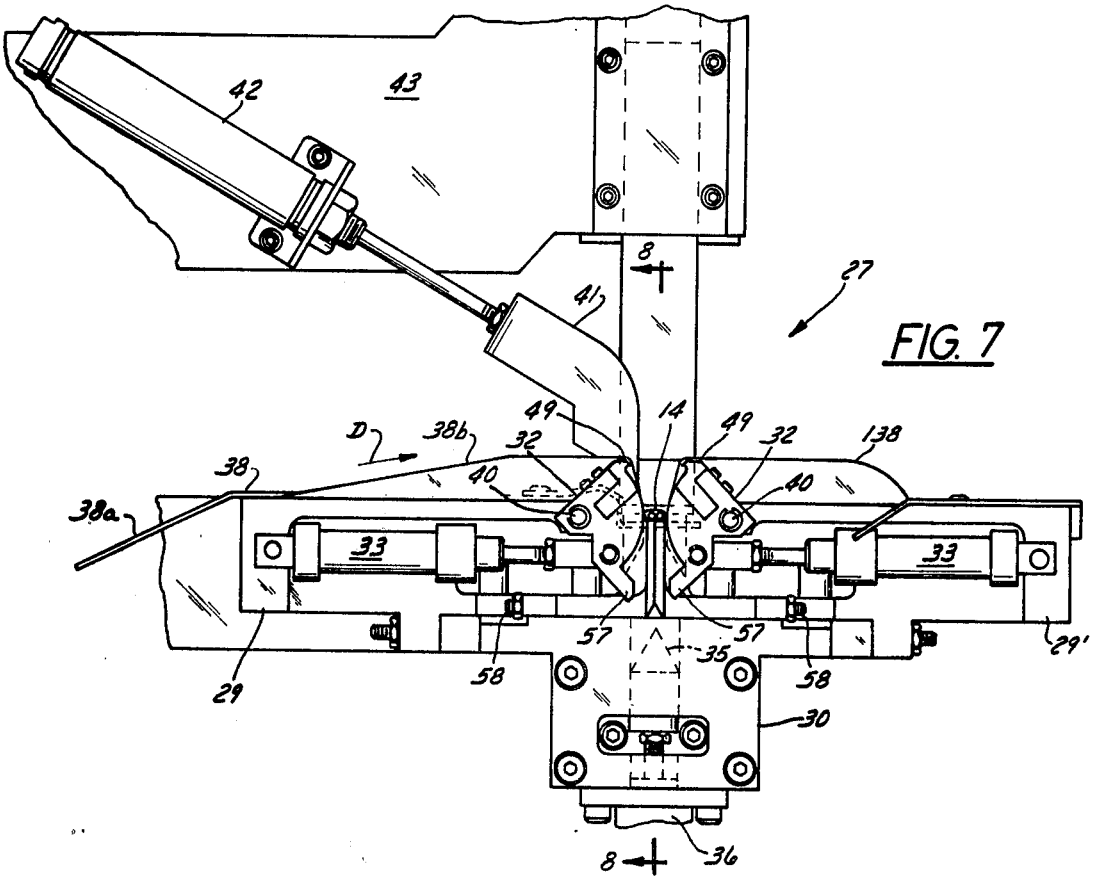
FIG. 7 is a view generally similar to FIG. 5 but showing the wire spreader in its condition in which a wire is established in proper relationship to it but with its clamping elements still in open condition and its carriages converged.
Figure 8:
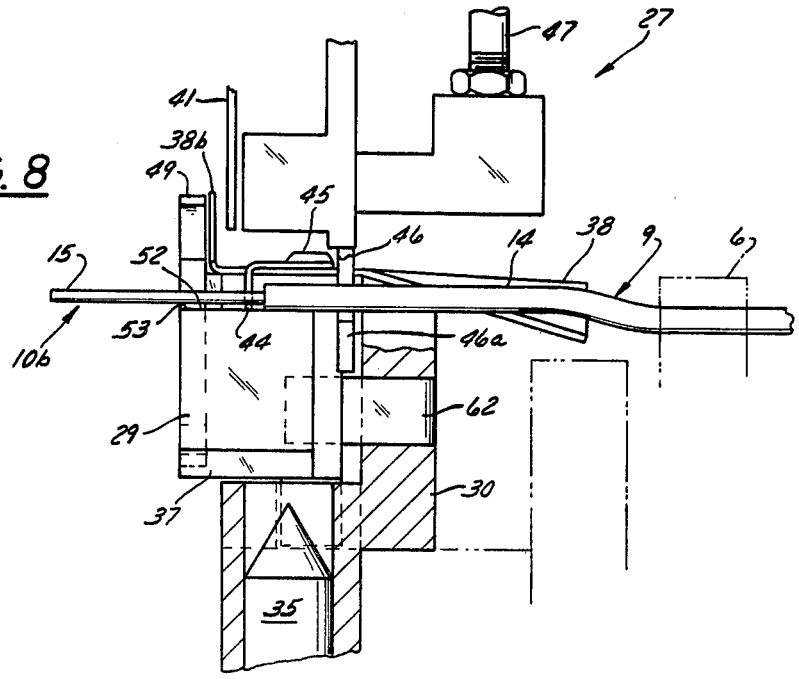
FIG. 8 is a detail view in vertical section taken on the plane of the line 8—8 in FIG. 7.

To overcome the tendency of the wire end portions to trail the rest of the cable length and remain in the position designated by 15′ in FIG. 5, the wires are positively moved off of the ramp 38 and into the throat between the clamping elements 32 by means of a claw-like pusher 41 that moves obliquely downwardly and in the direction D of conveyor motion. The pusher 41 is secured to the piston of a double-acting pneumatic jack 42 that is mounted on a bracket 43 on the machine frame 30, above the carriages 29, 29′ and the ramp 38. The pusher 41 can be made of sheet metal. During its extension, which can occur as soon as the conveyor 5, 6 comes to a stop, the path of the pusher 41 takes it edgewise between the clamping elements 32 and the ramp 38, as best seen in FIG. 6. It is retracted immediately after its extension.

When they are pushed off of the ramp 38, the plug-end portions of the wires 15 drop down onto the straight, horizontal portion of a springly elongated wire lifter 44. At one end (as at 45) the wire lifter 44 is secured to the carriage 29, and its straight portion, which is between the clamping elements 32 and the ramp 38 (FIG. 6) extends partway across the other carriage 29. In its normal, unflexed condition, the straight portion of the wire lifter 44 is at an elevation above the top surfaces of the carriages but below the tops of the raised clamping elements 32.

After the claw-like pusher 41 has extended and retracted, the pneumatic actuators 33 swing the clamping elements 32 down to their clamping positions, in which they are shown in FIG. 9. At about the same time, a vertically moving bifurcated pusher 46 is actuated downwardly to cooperate with the clamping elements 32 in overcoming the upward bias that the wire lifter 44 exerts upon the wires, securely seating them on the respective carriages 29, 29′.

The same bracket 43 that supports the obliquely moving claw-like pusher 41 also supports an upright pneumatic jack 47 that actuates the bifurcated pusher 46, that pusher being secured to the downwardly projecting piston rod of the jack 47. The bifurcated pusher 46 is mounted on the plane of symmetry of the carriages 29, 29′ but slightly behind them so that it engages the jacketed portion of the cable length to confine the same against both upward and lateral motion as the carriages swing apart, as can be seen in FIG. 6. The bifurcated pusher 46 thus cooperates with the clamping elements 32 in establishing and maintaining the plug-end portion of the cable in the proper location relative to the carriages 29, 29′. To that end, the downwardly projecting bifurcations 46*a* of the pusher 45 define between them a slot which converges upwardly a distance from its mouth and which is of such width in its upper portion that a cable jacket 14 is closely receivable therein. To adapt the pusher 46 for cables of different thicknesses, its bifurcations 46*a* comprise prong-like elements that are either mounted for adjustment towards and from one another or are readily removable to be interchangeable with others of different widths.

Figure 4:
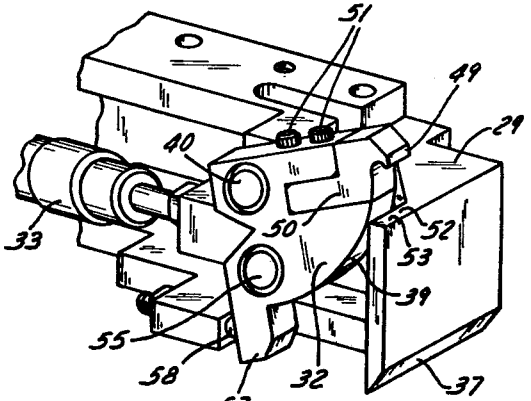
FIG. 4 is a detail perspective view of one of the carriages and its clamping element.
Figure 3:
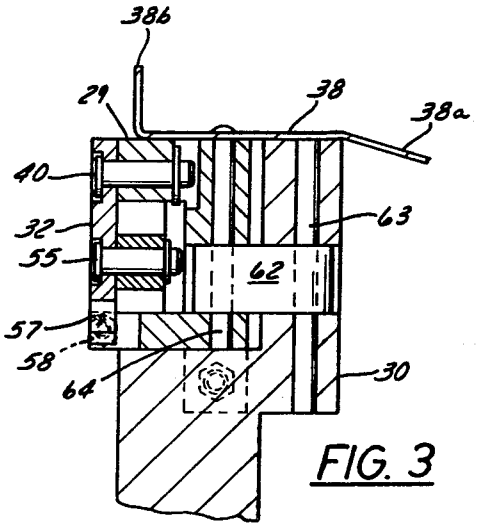
FIG. 3 is a detail sectional view taken on the plane of the line 3—3 in FIG. 2.

As best seen in FIG. 4, each of the clamping elements 32 has at its top a hook-like wire engaging protuberance 49 that projects radially outwardly beyond its arcuate surface 39. The under surface of that protuberance is concavely curved on a radius to match that of insulation on wire of a particular size. To adapt the clamping element for wire of different sizes, each of the protuberances 49 is formed on a block-like piece 50 that is removably received in a closely fitting slot in the clamping element body and is secured in that slot by screws 51. As also seen in FIG. 4, each carriage 29, 29′ is formed with a wire engaging portion 52 that projects forwardly across the arcuate surface 39 of its clamping element 32 and provides an upwardly facing flat surface 53 against which one of the wires 15 is clamped by the protuberance 49 of its clamping element.

The actuator 33 for each clamping element 32 is pivotally connected to the clamping element, as by means of a pin 55 that extends through the clamping element and the actuator piston rod, which pin is parallel to and spaced from the trunnion 40 upon which the clamping element swings. For fast, positive actuation of the clamping elements, the pneumatic jacks 33 exert considerable force, and therefore, to prevent crushing deformation of the insulation on the wires 15, downward travel of the clamping elements is limited, as by a downwardly projecting abutment portion 57 on each clamping element, engageable against an adjustable stop screw 58 that is threaded into the carriage (see FIGS. 4 9, 10). An upper limit of swinging of the clamping element is preferably also defined, as by engagement (FIGS. 5, 9, 10) of its top surface against an abutment 60 on the ramp 38, 138 that is secured to its carriage 29, 29′.

When the carriage actuating wedging element 35 is moved up by its pneumatic jack 36, diverging the carriages 29, 29′, the tip portions of the wires 15 are spread apart (FIGS. 11 and 12). To accmmodate the foreshortening of the wires that occurs as they are spread, the carriages move apart in horizontal translatory motion through a small arc that imparts a component of rearward motion to their separating motion. For such arcuate motion each of the carriages is connected with the machine frame by means of a parallelogram linkage comprising a pair of links 62 that have rear pivot connections 63 to the machine frame and front pivot connections 64 to the carriage, the axes of said pivot connections being upright and defining a parallelogram.

While the carriages 29, 29′ remain in diverged positions and the clamping elements 32 and the bifurcated pusher 46 remain down, the strippers 23 operate upon the wires 15, or a plug 19 is attached to them, as the case may be. Thereafter, while the carriages 29, 29′ remain diverged, the clamping element 32 and the bifurcated pusher 46 are raised, releasing the bent wires 15 to be raised by the wire lifter 44. As the conveyor 5, 6 begins to carry the cable length 9 away from the station comprising the wire spreader, the wires 15 are engaged by the ramp 138, which lifts them over the clamping element 32 on the carriage 29′.

STRAIGHTENING DEVICE

Figure 13:
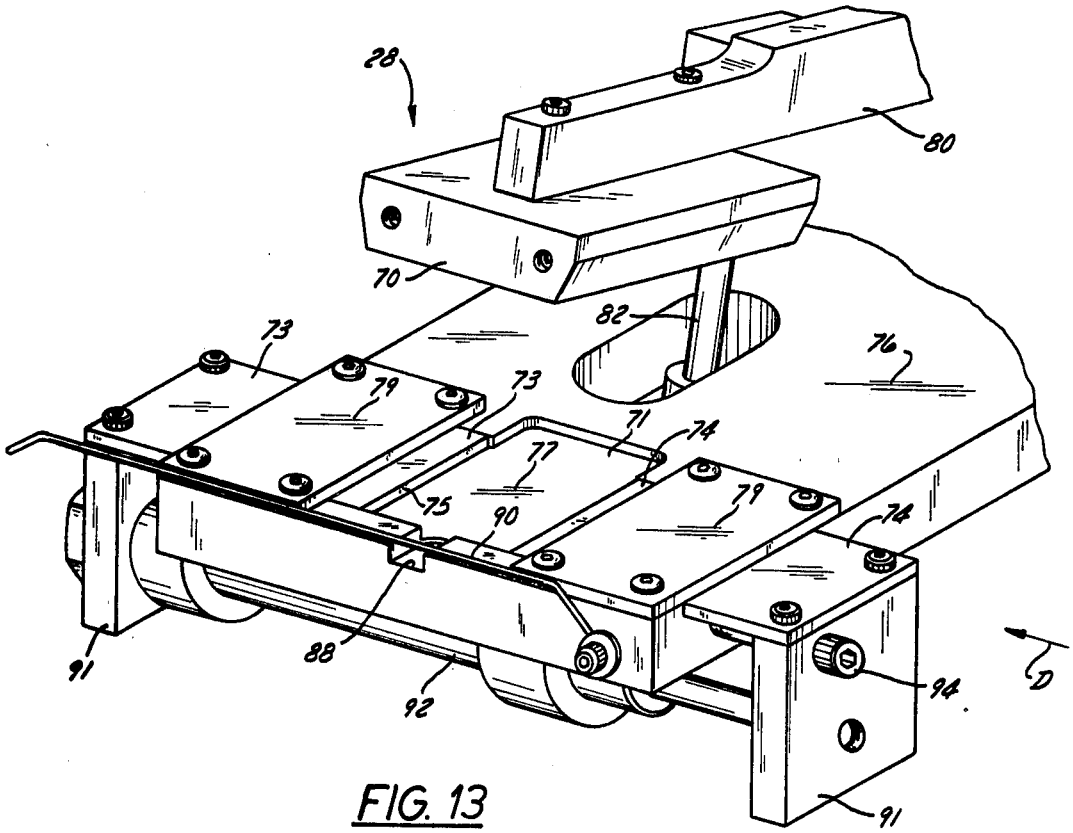
FIG. 13 is a perspective view of the wire straightening device of the machine of this invention.
Figure 14:
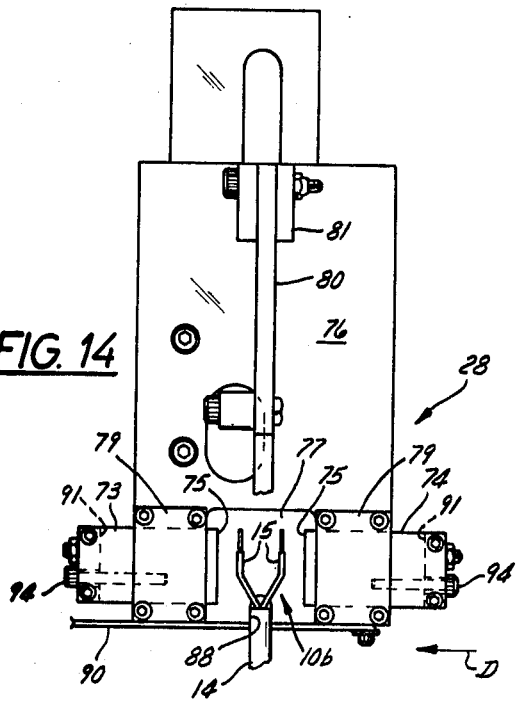
FIG. 14 is a top plan view of the wire straightening device in its initial wire receiving condition.
Figure 16:
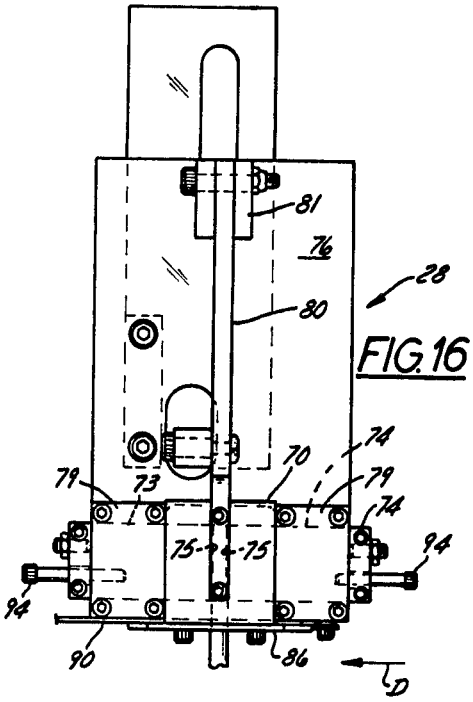
FIG. 16 is a view generally similar to FIG. 14 but showing the wire straightening device in the condition in which it has straightened plug-end portions of the wires.

The straightening device 28 comprises upper and lower jaw members 70 and 71 and a pair of horizontally movable jaw members 73 and 74. The lower jaw member 71 is fixed and has a substantially flat and horizontal top surface. The horizontally moving jaw members 73, 74 operate between the upper and lower jaw members. As a cable length is moved into the straightening station, both sets of jaw members 70, 71 and 73, 74 are in their open or diverged conditions (FIG. 13), and the plug end portions of the wires are brought to rest on the lower jaw member 71. While the horizontally movable jaw members 73 and 74 remain open, the upper jaw member 70 is moved down to a closed position in which it cooperates with the lower jaw member to confine the two wires to coplanar relationship. The horizontally movable jaw members, which are plate-like and fit closely between the opposing surfaces of the upper and lower jaw members, having opposing flat vertical surfaces 75; and as they converge on the wires they bring them into proximity to one another and straighten them.

The lower jaw member 71 is formed on a vertically shallow base block 76 that is part of the fixed structure 30 of the machine and, specifically is defined by the flat bottom surface of a shallow, upwardly opening cavity 77 in the block 76. The top surface of the block 76 also has elongated grooves or slots which open from opposite sides of the cavity 77 and wherein the respective horizontally movable jaw members 73, 74 are slidably guided for their opening and closing movement, parallel to the direction D of conveyor motion. The jaws 73, 74 are retained in their slots by cover plates 79 that are secured to the top surface of the block 76.

The upper jaw member 70 comprises a flat-bottomed block which is receivable in the cavity 77 and which is mounted on one end of a lever 80 that is pivoted at its other end to an upright bracket 81 on the base block 76. The lever 80 is swung up and down by means of an upright pneumatic jack 82 that has the lower end of its cylinder connected to stationary structure of the machine, as at 83, and has its piston rod projecting up through a hole in the block 76 and pivotally connected, as at 84, to the medial portion of the lever 80.

As the upper jaw swings down with the lever 80, a bifurcated, downwardly projecting cable locating plate 86 on it is brought to a position adjacent the rear surface of the base block 76. The bifurcations of the locating plate 86 define a downwardly opening slot 87 which is very wide at its bottom and tapers to an upper portion that is just wide enough to receive the jacketed portion of the cable. As the lever 80 comes down, the locating plate cammingly centers the jacketed portion of the cable in a groove 88 that opens rearwardly from the cavity 77 in the base block 76, thus confining the cable against lateral motion.

Figure 15:
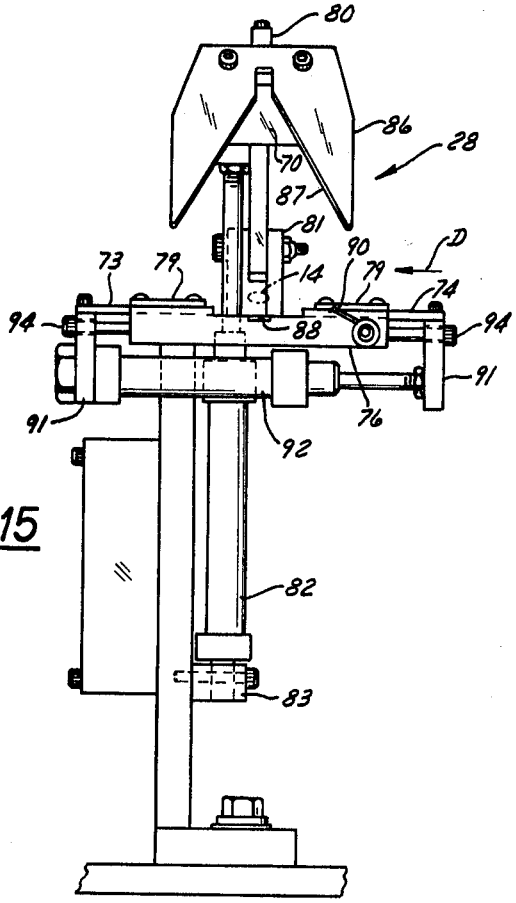
FIG. 15 is a view in front elevation of the wire straightening device in the condition in which it is shown in FIG. 14.
Figure 17:
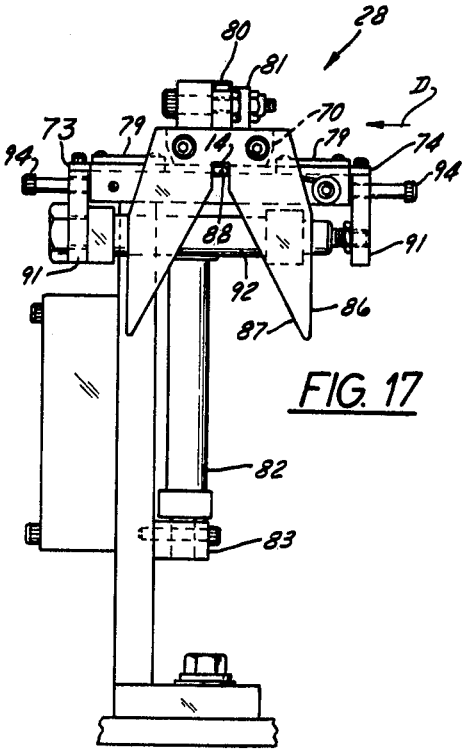
FIG. 17 is a view generally corresponding to FIG. 15 but showing the wire straightening device in its FIG. 16 condition.

The bifurcated cable-locating plate 86 comes down behind a resilient elongated wire lifter 90 that lies closely adjacent to the rear surface of the base block 76 and extends lengthwise in the direction D of conveyor movement. When unflexed (see FIGS. 13 and 15) the wire lifter 90 supports the jacketed portion of the cable at a level above that of the top surface of the block 76, to help the cable pass over the cover plates 79 during conveyor movement. The wire lifter 90 is of course resiliently depressed through the cable as the upper jaw descends.

The horizontally movable jaws 73, 74 have remote end portions which project beyond the base block 76 and to each of which a downwardly projecting bracket 91 is secured. A pneumatic jack 92, connected between the brackets 91, so reacts between the plate-like jaw members 73, 74 that they have no defined positions to which they are brought when converted, except insofar as they cooperate with one another in clamping a pair of wires to be straightened. However, each jaw member 73, 74 is actuated to a defined extended position at which the outer face of its bracket 91 engages the head of a stop screw 94 that extends through a hole in the bracket and is threaded into the base block 76.

From the foregoing description taken with the accompanying drawings, it will be apparent that this invention provides an improved lead-forming machine which eliminates the need for movable wire-bending and wire-holding fixtures as well as the conveyor means heretofore employed for imparting stepwise movement to such fixtures, and which is therefore less expensive and substantially less complicated than prior apparatus intended for the same purpose.

What I claim is:

1. In a wire lead forming machine wherein a cable length is constrained to stepwise motion transversely to its length in one direction along a defined path, to a stripping station at which insulation is stripped off of one end portion of each of a pair of wires of the cable length by means of stripping devices that rotate on fixed parallel axes, and subsequently to a plug attachment station at which said wire end portions are brought into axially inserted relationship to respective tubular plug legs that are in spaced parallel relation to one another, means for controlling the position and orientation of said end portions of said wires at each of said stations to ensure that they will have coaxial relationship to said rotary devices at the stripping station and to said plug legs at the plug attachment station, said means comprising:

A. a wire holding and bending device at each of said stations for receiving said end portions of said wires when they are substantially straight and laterally adjacent to one another and for bending said end portions apart to establish their tip portions in spaced substantially parallel relationship;

B. straightening means at a straightening station along said path that is between and spaced from said stripping and plug attachment stations, said straightening means comprising (1) a first pair of jaws relatively movable between an open position at which said end portions of the wires are receivable between the jaws as the cable length is moved into said straightening station and a closed position at which opposed confining surfaces on the jaws confine said end portions to substantially coplanar relationship, and (2) a second pair of jaws relatively movable towards and from one another between said confining surfaces and having opposed pusher surfaces which are substantially normal to said confining surfaces and whereby confined end portions of the wires are displaced into substantially straight laterally adjacent relationship.

2. The wire lead forming machine of claim 1 wherein said one direction is substantially horizontal, further characterized by:

(1) one of the jaws of said first pair being fixed and having its confining surface facing upwardly, and the other being movable substantially vertically towards and from it; and (2) the jaws of said second pair being movable in directions substantially parallel to said defined path and having opposed substantially vertical pusher surfaces.

3. The wire lead forming machine of claim 1 wherein said defined path extends substantially horizontally and wherein each of said wire holding and bending devices comprises:

(1) a pair of carriages confined to substantially translatory motion towards and from one another in directions substantially parallel to said path, each of said carriages having a substantially horizontal top surface on which a straight end portion of a wire is receivable and which is adjacent to the other carriage, said surfaces on the two carriages being substantially coplanar;

(2) a clamping element on each carriage, movable relative thereto between a raised open position and a lowered clamping position wherein the clamping element confines a wire against said top surface on its carriage so that with the clamping elements in their clamping positions the carriages can be moved apart to bend the end portions of the wires to spaced apart substantially parallel relationship.

4. The wire lead forming machine of claim 3, further characterized by:

(3) said carriages being biased towards one another;

(4) said carriages having adjacent obliquely opposed inclined wedging surface at their bottoms; and (5) an actuator element movable up and down beneath said carriages, said actuator element having an upwardly tapered upper end portion wedgingly engageable between said wedging surfaces to drive the carriages apart in consequence of upward movement of the actuator element.

5. A wire lead forming machine wherein a cable length is carried for stepwise motion transversely to its length along a defined horizontal path to each of a pair of stations, having work performing means at each of said stations to operate upon one end portion of each of a pair of wires of the cable, and having wire holding means at each said station which must receive said end portions of the wires in substantially straight laterally adjacent relationship and which divergingly bends them and confines them with their tip portions parallel and spaced apart by a distance suitable for said work performing means, said machine being characterized by:

a restraightening device at a third station between said pair of stations and spaced from both of them, said restraightening device comprising:

A. a fixed lower jaw member having a substantially flat top surface upon which said end portions of the wires are receivable;

B. an upper jaw member movable down to and up from a closed position in which a flat undersurface thereon is in opposed substantially parallel relation to said surface on the lower jaw member and cooperates therewith to confine end portions of wires thereon in coplanar relationship; and C. a pair of other jaw members movable horizontally between said upper and lower jaw members in directions substantially parallel to said path, said other jaw members having opposing, substantially flat upright surfaces which, during their convergence, engage wires between the upper and lower jaw members and force them into substantially straight laterally adjacent relationship.

6. The wire lead forming machine of claim 5, further characterized by:

D. a locator plate confined to edgewise up and down motion with said upper jaw member and having downwardly projecting bifurcations which define a downwardly opening and upwardly tapering slot, said locator plate being so located and arranged that its bifurcations engage a portion of a cable length that is spaced from the said tip portions of its wires and center that portion of the cable length in relation to said other jaw members.

* * * * *